US005992829A

United States Patent [19]

Andreasson

[11] Patent Number: 5,992,829

[45] Date of Patent: Nov. 30, 1999

[54] TEMPERATURE COMPENSATED CHOKE

[75] Inventor: Bo Andreasson, Ytterby, Sweden

[73] Assignee: Aktiebolaget Electrolux, Stockholm, Sweden

[21] Appl. No.: 08/817,852

[22] PCT Filed: Oct. 20, 1995

[86] PCT No.: PCT/SE95/01245

§ 371 Date: Apr. 18, 1997

§ 102(e) Date: Apr. 18, 1997

[87] PCT Pub. No.: WO96/12882

PCT Pub. Date: May 2, 1996

[30] Foreign Application Priority Data

Oct. 21, 1994 [SE] Sweden ..... 9403627

[51] Int. Cl.[6] ..... F02M 1/10

[52] U.S. Cl. ..... 261/35; 261/39.1; 261/39.3

[58] Field of Search ..... 261/35, 64.6, 39.3, 261/39.4, 39.5, 39.1, 34.3, 39.2, 63

[56] References Cited

U.S. PATENT DOCUMENTS

| | | | |
|---|---|---|---|
| 1,133,872 | 3/1915 | Maness | 261/39.3 |
| 1,968,553 | 7/1934 | Heitger | 261/39.3 |
| 2,110,211 | 3/1938 | Farrell | 261/39.3 |
| 2,868,185 | 1/1959 | Bellicardi | 261/39.5 X |
| 3,642,256 | 2/1972 | Phelps | 261/39.5 |
| 3,836,128 | 9/1974 | Lunsford | 261/63 X |
| 4,770,823 | 9/1988 | Sejimo | 261/39.1 |
| 5,200,118 | 4/1993 | Hermle | 261/64.6 |

FOREIGN PATENT DOCUMENTS

| | | | |
|---|---|---|---|
| 52-61646 | 5/1977 | Japan | 261/39.5 |
| 52-66120 | 6/1977 | Japan | 261/39.5 |
| 53-11239 | 2/1978 | Japan | 261/39.5 |

*Primary Examiner*—Richard L. Chiesa
*Attorney, Agent, or Firm*—Pearne, Gordon, McCoy & Granger LLP

[57] ABSTRACT

Fuel supply system (1) for internal combustion engines, arranged in a suction channel (2) leading to the engine body proper, the system (1) comprising one or several air-regulating valves (5,6) and one or several nozzles (3,3'). A cavity (7) or channel is provided in the wall of the suction channel (2) and is positioned in such a manner that when the air-regulating valve (5,6) assumes its closed position the cavity or the channel creates a communication path (21) from one side of the air-regulating valve to the other one, and in that an at least partly movable body (8) is positioned adjacent the cavity (7) or channels in such a manner as to be able to affect the through-flow resistance in the communication path (21). The position of the movable body (8) is controlled by a temperature-responsive member (9), for instance a bimetal element.

13 Claims, 6 Drawing Sheets

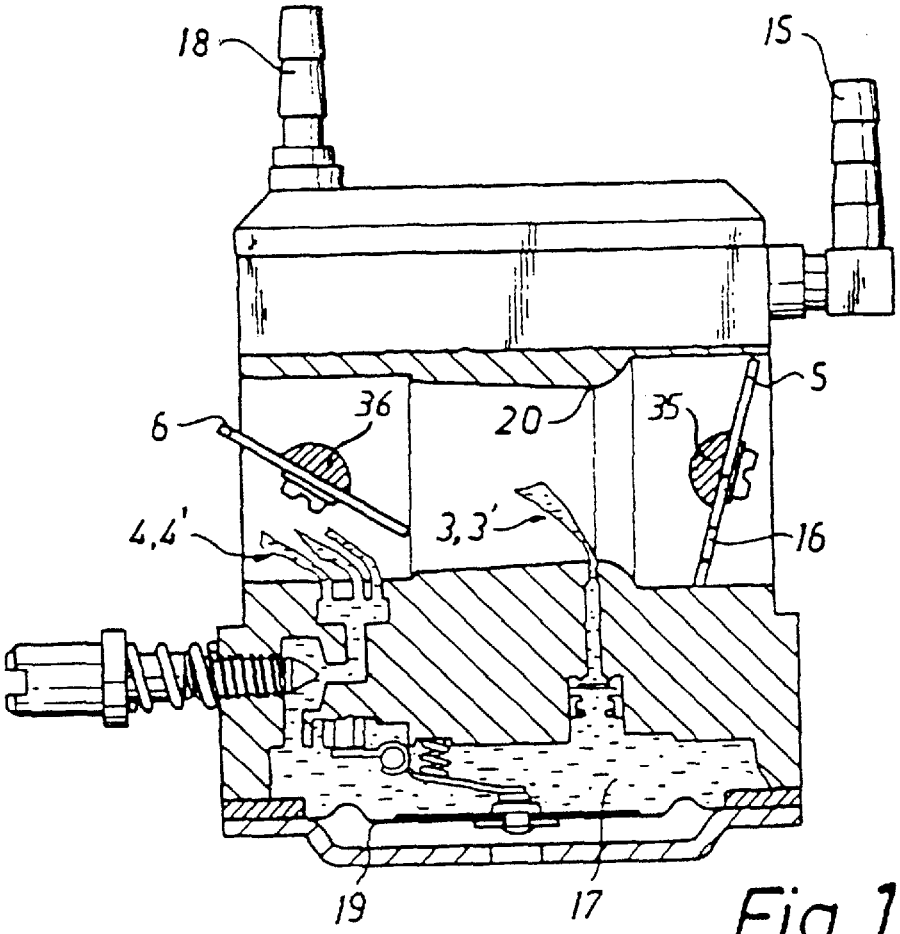
Fig. 1
PRIOR ART
Fig. 2
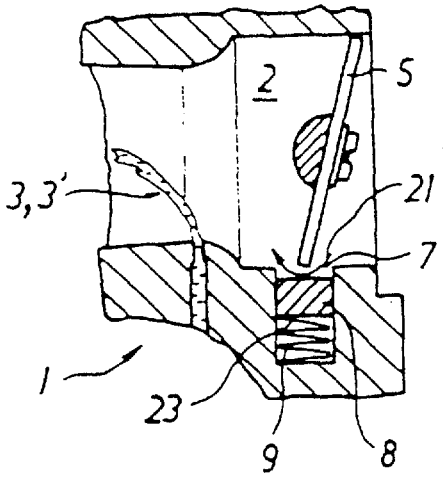

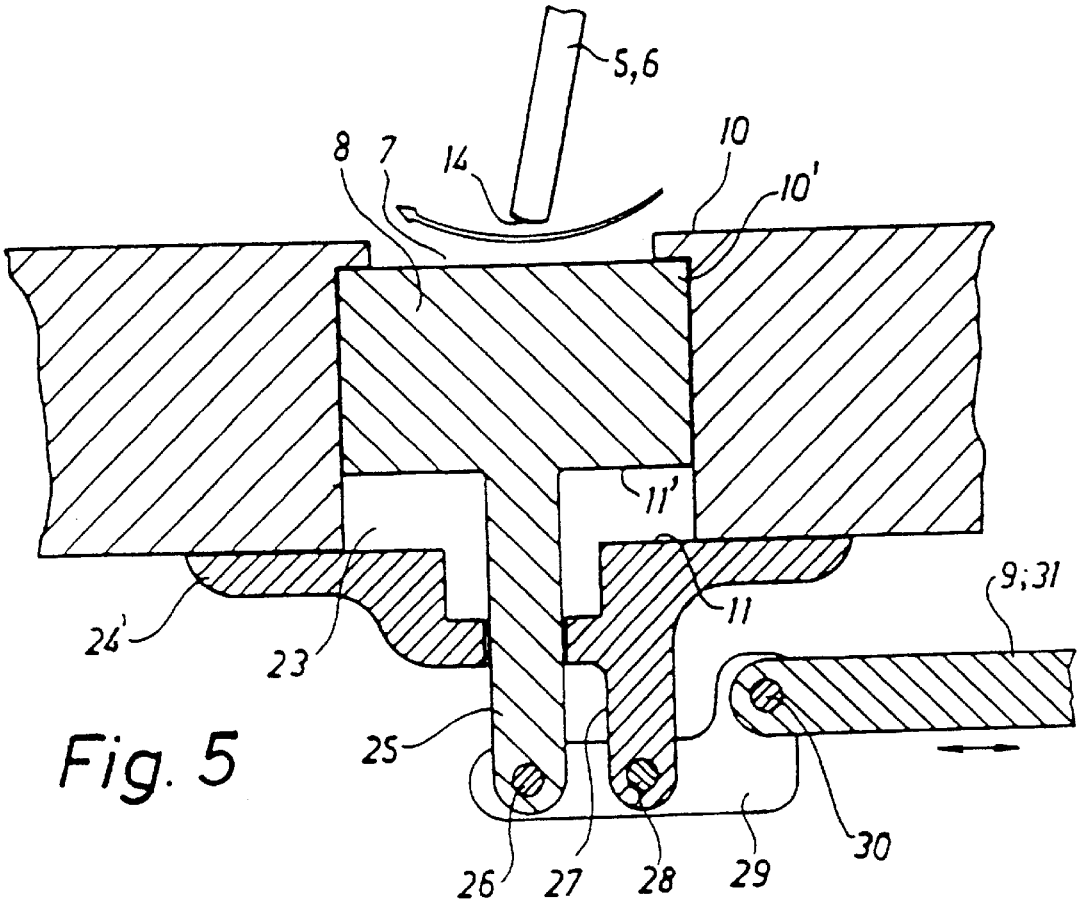
Fig. 5
Fig. 6
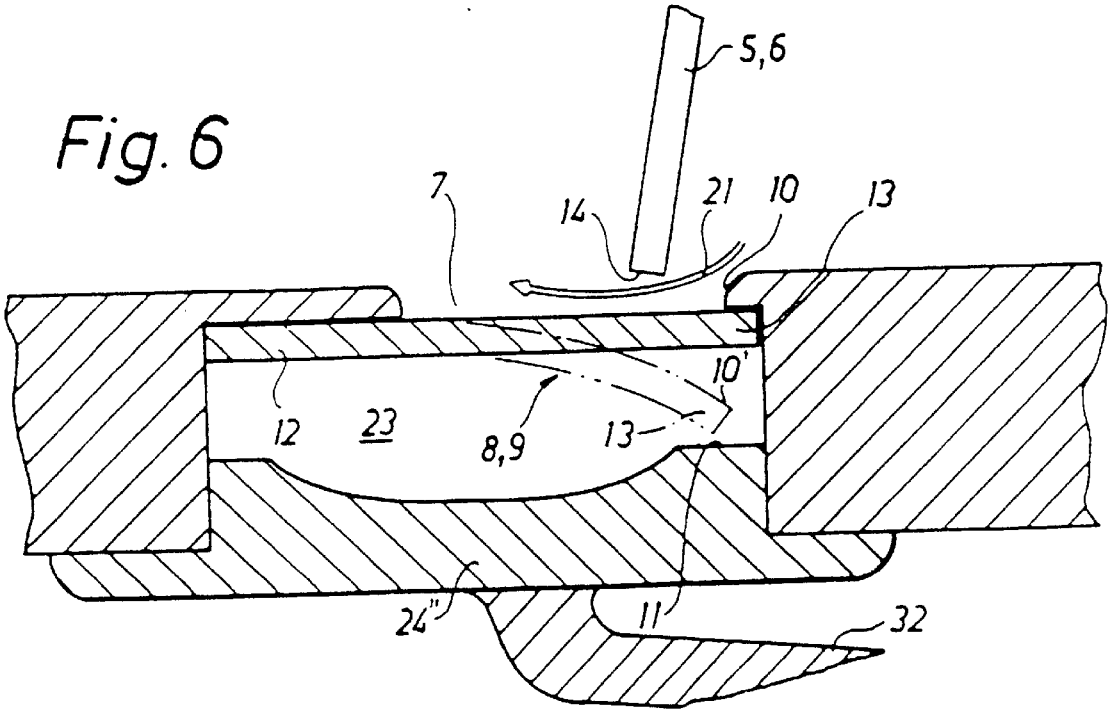

TEMPERATURE COMPENSATED CHOKE

TECHNICAL FIELD

The subject invention concerns a fuel-supply system for an internal combustion engine arranged in a suction channel leading to the engine body proper, said system comprising one or several air-regulating valves and one or several nozzles adjacent said valves.

BACKGROUND OF THE INVENTION

Carburettors for two-stroke or four-stroke engines are arranged in a suction channel leading to the engine body proper. Often, the carburettor has two air-regulating valves, viz. one throttle valve or air throttle and one choke valve. The throttle valve is used to control the throttle whereas the choke valve is used for cold starts. Usually, the choke valve closes entirely manually or automatically. A small opening in the choke valve ensures that only a minute amount of air flows past the valve upon starting attempts. As a result a very powerful negative pressure generates inside the suction channel adjacent the downstream nozzles. Consequently, a lot of fuel is supplied, giving a very rich air fuel mixture. This is necessary, since large quantities of fuel condensate on the walls of the suction channel, the crank case and the combustion chamber under these conditions. Carburettors do also exist that are equipped with one single air-regulating valve which in this case acts both as a throttle valve and a choke valve. Further, there are injection systems having a separate starting system including choke valves and starter nozzles that work in accordance with the carburettor principle. During start-ups the fuel amount is heavily influenced by the negative pressure from the choke valve.

It is characterstic of these kind of fuel supply system that during cold starts an air-regulating valve, usually designated choke valve, is almost fully closed whereby a heavy negative pressure is formed downstream of the air-regulating valve. Very often the valve is fully closed and a small opening ensures the required by-pass of a small amount of air. Obviously, it is also possible to use an end-position stop means for the air-regulating, valve whereby the latter will gape slightly open and no air opening is required. The size of the minute air opening is dimensioned to suit the lowest starting temperature at which the product usually is used. In the case of chainsaws this temperature could be e.g. −25° C. This means that at higher temperature levels, for instance +20° C., the air opening is too small to provide an accurate fuel-air mixture at start-ups. This gives an unnecessarily rich fuel mixture and complicates or prevents the starting function. In addition, the rich fuel mixture leads to unnecessary engine sooting and unnecessarily large exhaust emissions. For when the product is started the choke is turned to full open, since in reality it is hardly possible to "finely tune" the controls ensuring that the air opening coincides with the demand.

PURPOSE OF THE INVENTION

The purpose of the invention is to essentially reduce the above-outlined problems.

SUMMARY OF THE INVENTION

The above purpose is achieved by means of a fuel supply system in accordance with the invention having the characteristics appearing from the appended claims.

The fuel supply system in accordance with the invention thus is essentially characterized in that at least one cavity or channel is arranged in the wall of the suction channel and so positioned that when the air-regulating valve is in its closed position the cavity or channel will create a communication path from one side of the air-regulating valve to the opposite one, and in that an at least partly movable body, such as a plunger or a secured membrane, is positioned adjacent the cavity or channel in such a manner that it is able to affect the through-flow resistance in the communication path from one side of the air-regulating valve to the opposite one by forming a throttle in the communication path, and in that the position of the movable body, and thus the size of the throttling, is controlled by a temperature-responsive member, such as a bimetal element, whereby below a certain temperature, such as −25° C., the throttling is at its maximum whereas it decreases at higher temperatures. This means that a communication path provided with a variable throttling feature is created in the suction channel wall. A temperature-sensitive element, such as a bimetal element, varies the size of the throttling, ensuring that it matches the requirement at the temperature level in question. In other words, when the user closes the choke valve fully the temperature-sensitive element ensures that the communication path past the choke valve, or the throttle valve, is exactly adapted to the desirable temperature, whether the latter is −25° C. or +10° C., and so on. Owing to this arrangement, the engine will start more easily at most temperature levels while at the same time the sooting becomes less and the exhaust emissions during start-ups are lower. These and other particularities and advantages will become apparent upon reading of the following detailed description of various embodiments with the support of the appended drawings.

BRIEF DESCRIPTION OF THE DRAWINGS

The invention will be described in closer detail by way of embodiments with reference to the accompanying drawings, wherein FIG. 1 is a cross-sectional view from the side of a conventional membrane carburettor which may be fitted with the fuel supply system in accordance with the invention.

FIG. 2 is a cross-sectional view from the side of a fuel supply system according to the invention.

FIG. 5 is a detailed enlargement of a somewhat different embodiment of the invention shown in FIG. 2.

FIG. 6 is a detail enlargement of a further embodiment of the invention illustrated in FIG. 2.

DESCRIPTION OF VARIOUS EMBODIMENTS

Figure 3:
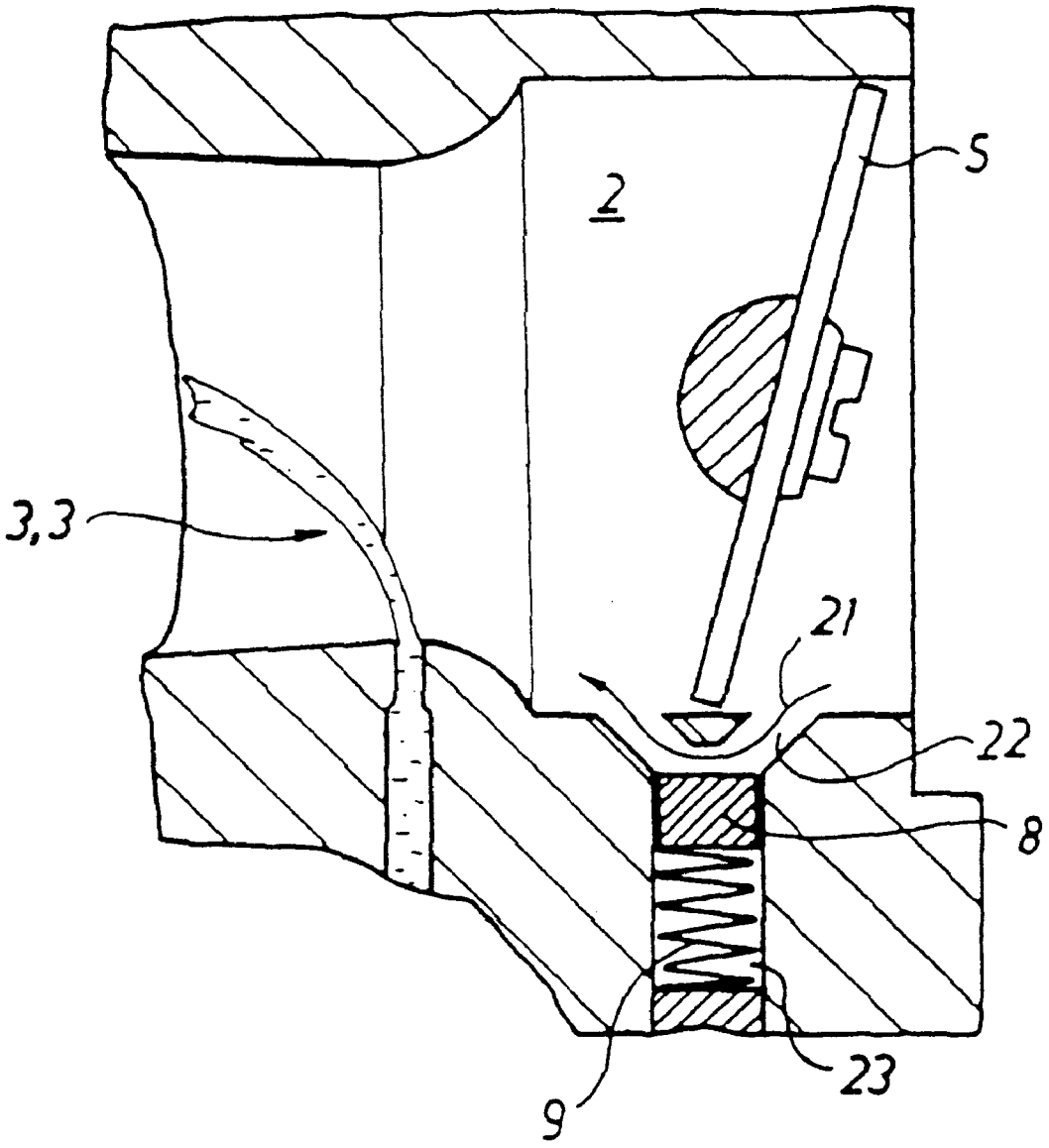
FIG. 3 illustrates a further embodiment of a fuel supply system according to the invention.

FIG. 1 illustrates a conventional membrane carburettor in a cross-sectional view. The fuel is supplied to a fuel inlet 15 and is pumped down to a metering chamber 17. The pumping takes place in an entirely conventional way with the aid of a membrane pump driven by the engine pressure pulses in a connection 18. The metering chamber 17 is delimited downwards by a membrane 19, thus the denomination membrane carburettor. Fuel is supplied to the engine suction channel 2 by means of one or several main nozzles 3, 3'. The latter are arranged in a venturi section 20 of the suction channel 2. One or several starter nozzles 4, 4' are arranged downstream of the venturi section 20. In addition to air-regulating valves 5, 6 are arranged in the suction channel 2. In the embodiment illustrated, the valves are of rotational type but could also be of sliding type. Valve 6 is in this case a throttle valve or air throttle and 5 a choke valve. Normally, the choke valve 5 is formed with an aperture 16 allowing a small amount of air to pass through also when the valve is entirely closed. The construction of the membrane carburettor so far is entirely conventional and for that reason will not be discussed in further detail.

FIG. 2 illustrates a fuel supply system 1 in accordance with the invention as seen in a lateral cross-sectional view. The system in accordance with FIG. 2 is a part cut from a fuel supply system which could be of a carburettor type or a fuel-injection type. When of carburettor type the carburettor has one air-regulating valve 5 or two air-regulating valves 5, 6 as in FIG. 1. When the system is fitted with two air-regulating valves the valve 5 is denominated choke valve. When the system is equipped with one air-regulating valve 5 only, the latter is denominated throttle valve. It is characteristic of the invention that a communication path 21 is created from one side of the air-regulating valve 5, 6 to the opposite one when the valve is in its closed position. This communication path 21 is arranged in the wall of the suction channel 2. In this respect, it differs from the aperture 16 which normally is formed in the choke valve 5 as in FIG. 1. When the valve 5 is fully closed, air thus will flow along the communication path 21. The communication path is formed in that a cavity 7 is made in the wall of the suction channel 2. A hole 23 debouches into the cavity 7. The hole 23 is formed with essentially parallel lateral walls and a movable body 8 is received in the hole 23. The body 8 is shaped in conformity with the hole, and has for instance a circular, an oval or a rectangular cross-sectional shape, allowing the body 8 to be movable in the axial direction of the hole. The movable body 8 could for instance be in the shape of cylindrical plunge or a secured membrane. The position of the movable body 8 is affected by a temperature-sensitive element 9, for instance a bimetal element, such that below a certain temperature, e.g. −25° C., the movable body 8 throttles the communication path 21 to a maximum. The throttling decreases at higher temperatures when the temperature-sensitive elemeint 9 contracts, pulling the movable body 8 downwards, thus increasing the depth of the cavity 7. In this manner the through-flow resistance in the communication path 21 is reduced.

Member 9 is shown schematically in the drawing-figure. The member could be made from so called memory metal. It could be in the shape of a conventional helically coiled spring but also be shaped as a folded spring or consist of several assembled pieces.

FIG. 3 illustrates a somewhat different embodiment of the communication path 21. Instead of being a cavity 7 in the wall of the suction channel 2, it is in this case shaped as a channel 22 formed in the wall of the suction channel 2. In other words, the communication path 21 is formed by a channel 22. Preferably, the channel consists of two sections running obliqly inwardly into the housing wall so as to merge a distance below the surface. The two parts of the channel could be machined or may be formed in a moulding process. A bore 23 preferably is drilled in the suction channel wall so as to debouch in the channel 22. The bore 23 has essentially parallel side faces and the movable body 8 is received in the bore in exactly the same way as in accordance with the previous embodiment. Thus, the body 8 is movable in the axial direction of the bore and its position is controlled by the temperature-responsive member 9. In both these cases the movable body 8 thus is a plunger travelling inside a bore 23 debouching into the cavity 7 or channel 22. However, the movable body could also be in the form of a membrane which is secured adjacent the cavity or the channel. In this case, the temperature-dependent member 9 affects the membrane and thus the throttling of the communication path 21.

Figure 4:
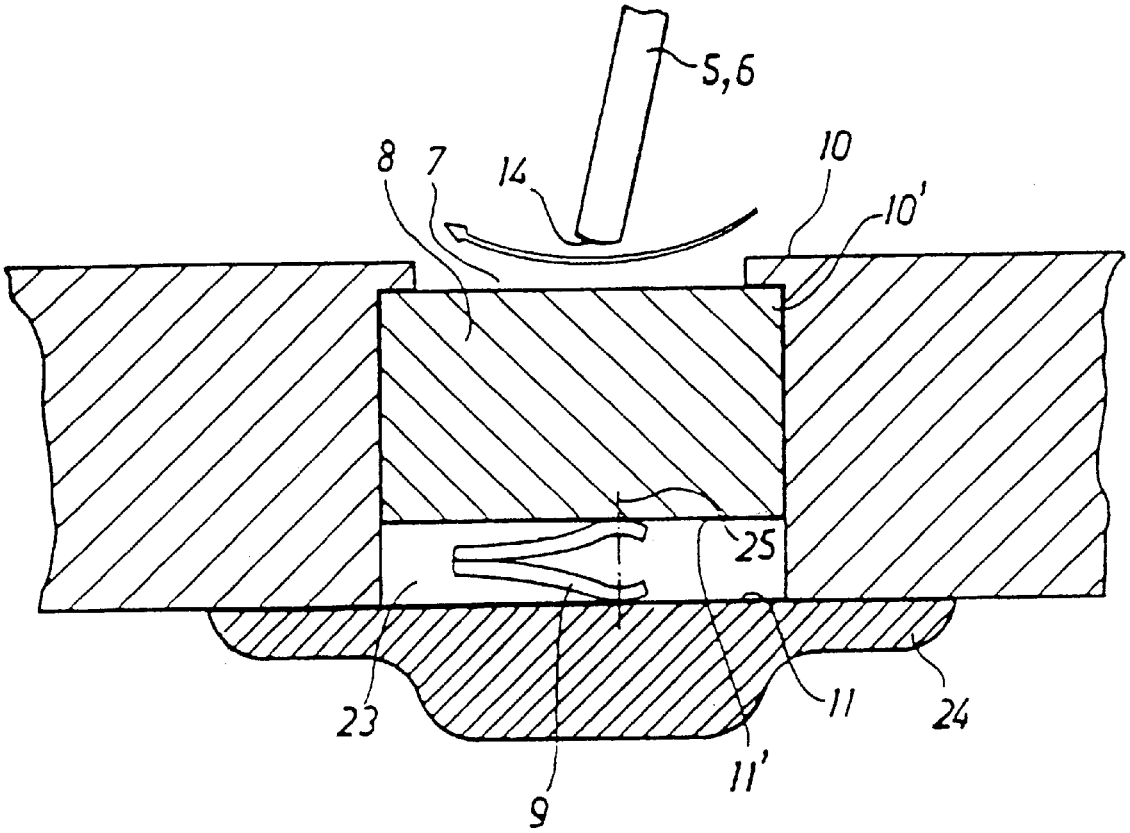
FIG. 4 is a detailed enlargement of one embodiment of the invention similar to that shown in FIG. 2.

FIG. 4 is a detail enlargement of a solution corresponding to that of FIG. 2. In other words, the cavity 7 affords a communication path 21 from one side of the air-regulating valve 5, 6 to the opposite one. However, in this case cooperating abutment faces 10, 10' and 11, 11', respectively, have been made in the bore 23 and the movable body 8. These abutment faces limit the movement of the body in both axial directions. Obviously, it could also be of interest to use these cooperating abutment faces for limitation of movements in one axial direction only. Thus, the plunger 8 is pulled by the temperature-responsive member 9 in such a manner that at a temperature of −25° it assumes the position illustrated whereas at higher temperatures it is pulled further and further away from the air-regulating valve 5, 6. The member 9, for instance being a bimetal element, is shown only schematically. It is shown as a composite piece made from two spring leaf parts of a bimetal or possibly a memory metal. The ends of the member 9 are attached to the body 8 and to the lid 24, respectively. This arrangement is suggested by means of the centre lines 25 relatively to two attachment elements. For instance screws, rivets or snap fasteners. Preferably the attachment is somewhat flexible. The member 9 could also be a bimetal spring leaf the free end of which exerts pressure on the plunger, compare FIG. 6. In addition it could consist of a number of interconnected bimetal spring leaves which are assembled into a stack similar to that of FIGS. 2 and 3. The stack contracts axially at higher temperatures and lengthens at lower ones. In this case, the stack 9 is secured between the lid 24 and the movable body 8.

FIG. 5 illustrates a solution including a movable body 8 similar to the one shown in FIGS. 2 and 3. However, the change of position of body 8 is achieved in an entirely different manner. The body 8 is provided with a shank 25 which extends through the lid 24', preferably with some kind of sealing also being provided. The outer end of the shank 25 is provided with a pivot 26 on which a pivotable arm 29 is mounted. The pivotable arm is rotatably mounted about a pivot 28 formed in a projecting portion 27 of the lid 24'. A temperature-responsive member 9 is pivotally mounted at the opposite end of the pivotable arm 29 in pivot 30. The temperature-responsive member 9 preferably is made from material having a high or comparatively high longitudinal expansion coefficient. The opposite end of the member, i.e. the end remote from the pivot 30, preferably is attached to the engine crank case or cylinder. Thus, the member 9 is heated by the engine such that the length of the member 9 well corresponds to the engine temperature, which is desirable. In this case the pivotable arm 29 is arranged to provide a gearing effect. This means that when the engine and thus the member 9 increase their temperature, the body 8 will be pulled downwards. The movement downwards of body 8 is longer than the change of length of the member 9, owing to the gearing effect. The rotary arm 29 may be configured in such a manner that the member 9 is able to move in most directions away from the movable body 8. In some cases it is likewise possible to eliminate the rotary arm 29 by replacing the pivot 30 with a groove at the end of member 9, which groove is angled relatively to the longitudinal extension of the member. Upon changes of length of the member the angled groove will impart a movement of advancement to the body 8. Obviously, the member 9 could be partly heat insulated in order to prevent surrounding air from cooling the member in a non-desirable manner. The advantage of this arrangement resides in the ability of the temperature-sensitive member 9 to detect a suitable engine temperature owing to its connection i.e. to the engine crankcase or cylinder. A large number of various arrangements for movement transfer to the movable body 8 thus is conceivable. In the illustrated case the temperature-responsive member 9 is affected directly by the engine temperature for instance at the crankcase or cylinders. It is likewise possible to position the temperature-responsive member 9 adjacent the crankcase or cylinder and arrange for movement transfer to the body 8. In this case e.g. member 9, such as a bimetal member, a memory metal element, or a rod, transfers the movement to the body 8 via a link arm. The movement transfer could also be effected with the aid of capillary tubes. However, it is likewise possible that the influence is effected indirectly. This situation is illustrated in FIG. 6, wherein a temperature-responsive member 32 is attached to the lid 24". The opposite end of the member 32 is then preferably attached to the crankcase or cylinder in order to detect a suitable engine temperature. For instance the member 32 could be in the shape of a wire or a rod of a metal possessing good heat conducting properties and in this case its external face preferably is heat insulated. Obviously, heat transfer could be effected with the aid of a liquid, a powder, or the like. In this case the lid 24" is heated whereby also the member 8, 9 assumes a temperature corresponding to the engine temperature. Obviously also solutions according to FIGS. 2–4 could be equipped with a temperature-responsive member in a similar manner.

FIG. 6 illustrates a somewhat different embodiment according to which the at least partly movable body 8 is combined with the temperature-responsive member 9. This is effected by attaching the member 9, e.g. a bimetal element having a comparatively elongate shape, to the wall of the suction channel 2 in the bore 23. In this case, the body or member 8, 9 is shaped as a spring leaf or plate having one secured end 12 and one free end 13. The end 12 could be attached by means of glue, screws, or rivets, to the wall of the suction channel 2. However, it could also be effected by clamping the member between the abutment face in the wall and the lid 24". The lid is preferably attached by means of screws or in any other suitable manner such that it closes the bore 23. In the drawing figure the free end of member 8, 9 is illustrated in its low-temperature condition, i.e. below approximately −25° C. A shoulder 10 in the bore 23 cooperates with the upper edge 10' of the member in order to limit the movement of member/body 8, 9 axially upwards. At higher temperatures the member is gradually deflected downwards, whereby the free end will be moved gradually further away from the throttle valve 5, 6. The dash and dot lines illustrate the position when the member 8, 9 has arrived almost all the way up to the lid 24" the upper edge 11 of which may serve as an abutment face 11. Upon this high temperature the throttling of the communication path 21 thus is considerably smaller than in the case of the lower temperature. In accordance with embodiments illustrated the communication path 21 is never entirely throttled at any temperature level. But obviously it would be possible to conceive such a design solution. It would then be suitable to provide an aperture 16 in the throttle valve as in FIG. 1. Obviously, it is likewise possible to provide a supplementary small aperture 16 in the throttle valve in combination with a heavily throttled communication path 21 at the lowest temperature level.

It goes without saying that the member 8, 9 should have a good fit in the bore 23. This is true particularly as concerns the upper regions of the bore close to the throttle valve 5, 6. In the lower regions the bore may be configured with more liberty. The member 8, 9 could also be used in connection with a channel 22 in accordance with FIG. 3. In this case the member 8, 9 is positioned for instance in a bore 23 connected with channel 22. However, the member could also be positioned inside channel 22 and in this case partly form the wall thereof.

Figure 7:
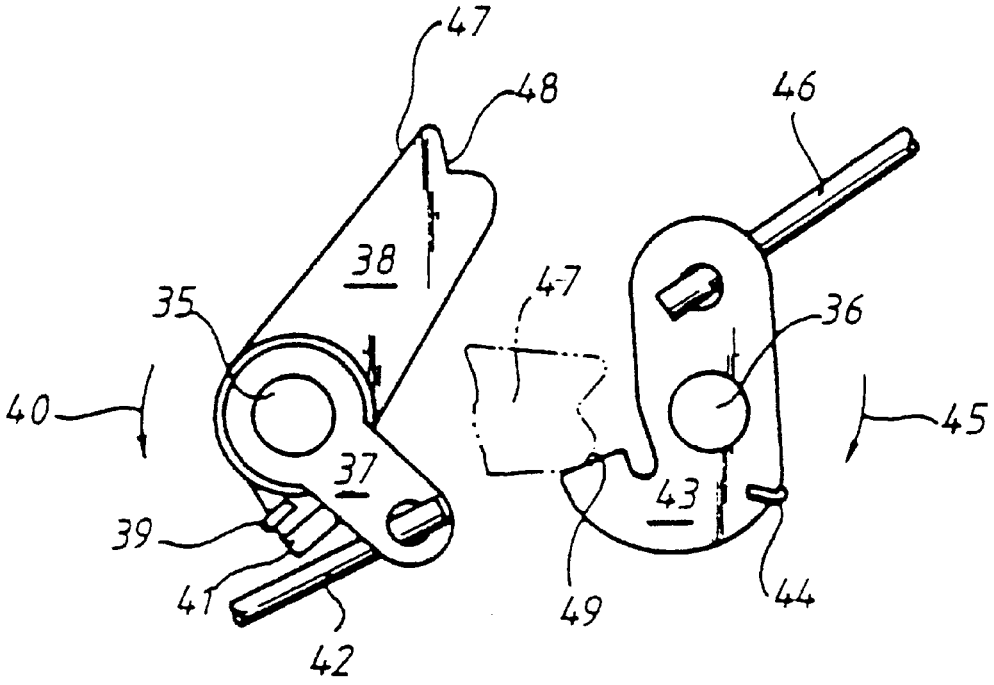
FIG. 7 is a schematical view of the position of the choke valve arms and the throttle valve arm in the respective positions of rest.
Figure 8:
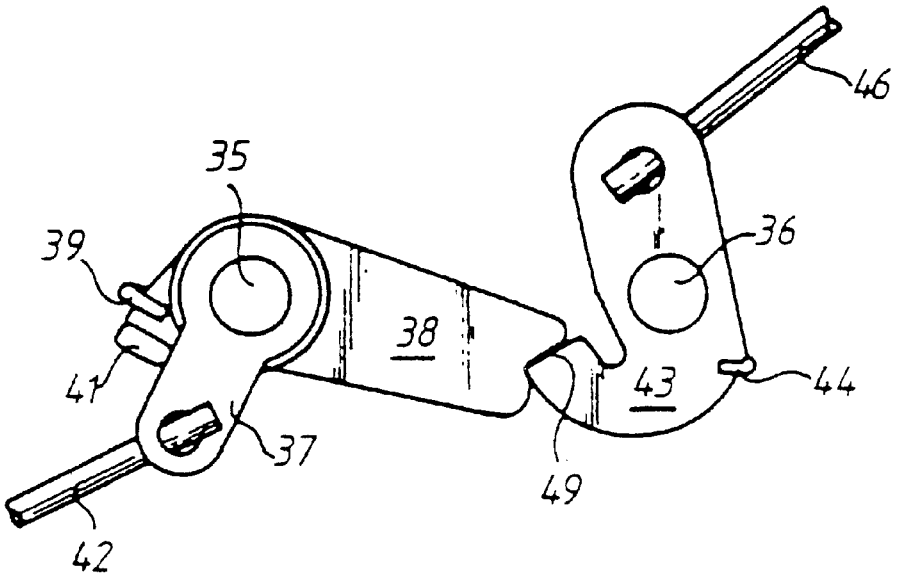
FIG. 8 illustrates schematically the position of the arms when the start-controls of the engine is engaged and the arms are hooked into one another in the so called starting position.

FIGS. 7 and 8 illustrate one embodiment of the arms for actuation of the choke and throttle valves, not necessary for utilizing the inventive object but advantageous in connection therewith. This relates to the case when two valves are used. When only one valve is used obviously this solution is not relevant. On the lever 35 controlling the choke are mounted one choke valve arm 37 and one blocking arm 38. The blocking arm 38 is affected by a pull-back spring 39 one end of which appears in the drawing figure. The pull-back spring turns the blocking arm 38 in the counter-clockwise direction as indicated by arrows 40 to the end position illustrated in the drawing figure. With the aid of a drive shoulder 41 acting against the choke valve arm 37 the latter is carried to the shown end position. In the shown position the choke valve is fully open and the actuating rod 42 assumes its normal position, i.e. the position wherein the engine-start control lever is not affected. The start control lever is secured to the opposite end of the operating rod 42. The throttle lever 36 is non-rotationally secured to the throttle valve arm 43. A pull-back spring 44 turns the throttle valve arm 43 in the clockwise direction in the same manner as pull-back spring 39, to the end position shown. In the end position the throttle valve is fully closed. An operating lever 46 affects the throttle valve arm 43 to open the throttle valve as desired. This is the position of departure when the engine, a power saw, is not used.

FIG. 8 illustrates a position of the levers when the engine is to be started. When the start control lever is engaged, the actuating rod 42 has exerted its pulling action of the choke valve arm 37 and with the aid of the drive shoulder 41 the latter has brought along the blocking arm 38 in the clockwise direction. The outer end 47 of the blocking arm 38 is formed with an indentation 48. When the outer end 47 reaches the position illustrated in FIG. 7 in dash-and-dot lines, it begins to turn the throttle valve arm 43 in the counter-clockwise direction. This continues until an abutment face 49 formed at one end of the throttle valve arm rides across the edge of the outer end 47 and reaches the indentation 48. The path of movement of the start control lever is adjusted to ensure that the arms 37, 38 and 43 reach precisely the desired position illustrated in FIG. 8. In this position a full-choke condition is reached while at the same time the throttle valve is slightly opened. This small opening of the throttle valve corresponds to the desired start throttle condition. As soon as the engine starts the start control lever may be pushed inwards. This turns the choke valve arm 37 whereas the blocking arm 38 still is hooked in the throttle valve arm 43. When the operator opens the throttle, the actuating rod 46 will turn the throttle valve arm 43 in the counter-clockwise direction, thus unhooking the blocking arm 38 and the latter returns to the position illustrated in FIG. 7. The arrangement in accordance with FIGS. 7 and 8 has several advantages. Firstly, a suitable start throttle condition is provided when the start control lever is pulled outwards. In the hooked condition the actuating rod 42 is not affected by spring action from the pull back spring 39. This allows the start control lever to be pushed inwards slowly after start. On the other hand, when the throttle is opened, the blocking arm 38 is liberated and the start control lever is pulled back. Secondly, the arrangement provides definite positions of the choke and throttle valves and these positions are repeated upon each starting instance. This is an important condition for obtaining a well tuned temperature correction for easier start-ups.

Figure 9:
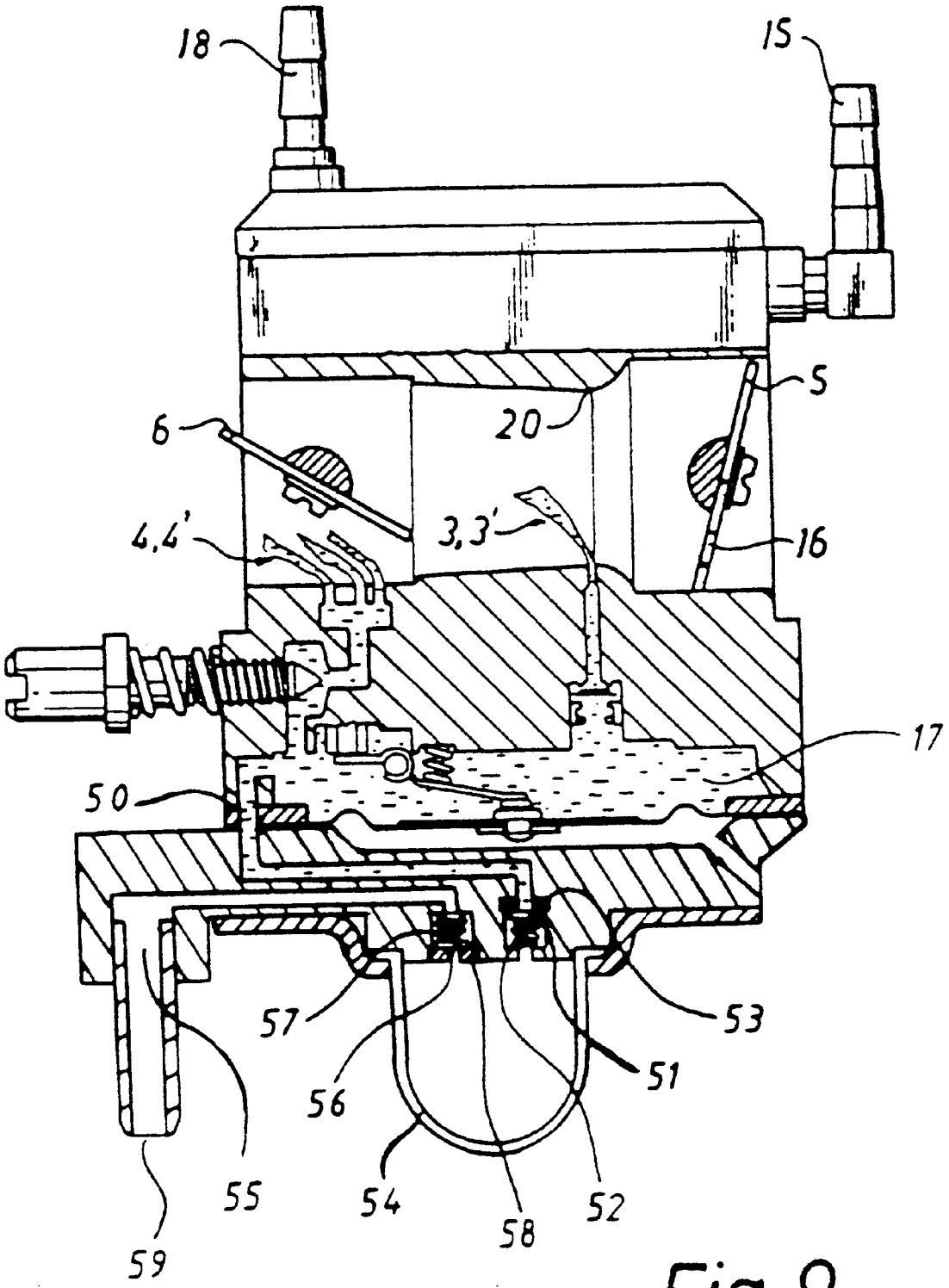
FIG. 9 illustrates the carburettor in accordance to FIG. 1, fitted with a particular pumping device.

FIG. 9 illustrates the manner in which the carburettor according to FIG. 1 is equipped with a particular pumping device. The latter has a suction line 50 leading via a check valve 51, 52, 53 from the carburettor metering chamber 17 to a manually actuated pumping means 54, for instance an elastic plastic or rubber bladder. From the carburettor leads a pressure line 55 via a check valve 56, 57, 58. When the operater depresses the bladder the latter is deflated and an outlet disc 56 is forced against an outlet spring 57, whereby air and/or fuel from the bladder 54 thus will pass the check valve and leave the pressure line 55. When the operator releases the bladder air and/or fuel is sucked from the metering chamber 11 to the bladder 54. This is a result of an inlet disc 51 being pressed against an inlet spring 52 in such a manner that air and/or fuel may pass the check valve. Preferably, both check valves are also provided with seals 53, 58 sealing against its respective one of discs 51, 56. Obviously, the check valves as well as the pumping means could be configured differently than described, for instance in a manner of a piston pump including membrane valves.

By repeatedly compressing and releasing the bladder the user effects pumping from the measurement chamber. The air and/or fuel leaving the metering chamber 11 is replaced by fuel only through the normal fuel supply system of the carburettor. Owing to the pumping it thus becomes possible to remove air from the metering chamber and the latter is instead completely filled by fuel. This is evidenced by fuel only exiting from the mouth 59 of the pressure line 55. During start-ups there is however a risk that the metering chamber may be partly filled with air, which would make it more difficult to start the engine. By pumping away air equal conditions are created for temperature compensation at each start up. Otherwise temperature-correction of the starter nozzle at higher temperatures could make it more difficult to start the engine than without the temperature correction. This would happen in cases when air present in the metering chamber would already give the required leaner mixture. Because all air is pumped away from the metering chamber at each start-up, conditions are created to obtain a well tuned temperature correction in order to facilitate start-ups.

I claim:

1. A fuel supply system (1) for internal combustion engines, arranged in a suction channel (2) leading to the engine body, said system (1) comprising at least one air-regulating valve (5, 6) and at least one fuel nozzle (3, 3'; 4, 4') positioned adjacent said at least one air-regulating valve (5, 6), wherein at least one passageway (7, 22) is provided in a wall of the suction channel (2) and is positioned such that when the air-regulating valve (5, 6) is in a closed position the passageway (7, 22) defines a communication path (21) from one side of the air-regulating valve (5, 6) to the other side of the valve, and wherein an at least partly movable body (8) is positioned adjacent the passageway (7, 22) so as to be able to affect the through-flow resistance in the communication path (21) from said one side of the air-regulating valve (5, 6) to said other side by forming a throttle in the path of the communication (21), and wherein the position of the movable body (8) and, thus, the size of the throttle, is controlled by a temperature-responsive member (9) such that below a certain temperature the throttle is at a maximum and the throttle decreases as temperature increases, and the passageway (7, 22) is arranged in a position upstream said at least one fuel nozzle (3, 3'; 4, 4') so that the supplied fuel amount is affected by the size of the throttle.

2. A fuel supply system (1) according to claim 1, wherein the movable body (8) is positioned in a bore (23) having essentialy parallel sede faces and has a configuration adjusted to that of the bore (23), and whereby the body (8) is movable in the axial direction of the bore, and said bore (23) debouches in the passageway (7, 22).

3. A fuel supply system (1) according to claim 2, wherein cooperating abutment faces (10, 10'; 11, 11') are formed in the bore (23) and the body (8) such that said abutting surfaces delimit movement of the body (8) in at least one axial direction.

4. A fuel supply system (1) according to claim 2, wherein a cross-section shape of the bore is selected from the group consisting of circular, oval, and rectangular.

5. A fuel supply system (1) according to claim 1, wherein the movable body (8) includes the temperature-responsive member (9), one end (12) of said temperature-responsive member is secured while an opposite end (13) is free, and wherein, as temperature increases, the free end (13) moves to reduce the throttling of the communication path (21).

6. A fuel supply system (1) according to claim 1, further comprising a temperature-transferring member (31), said temperature-transferring member (31) having one end connected to an engine part and an opposite end connected to the temperature-responsive member (9).

7. A fuel supply system (1) according to claim 6, wherein the temperature transferring member (31) is selected from the group consisting of a metal rod, a tube containing a liquid material, a tube containing a pulverized material, a hose containing a liquid material, and a hose containing a pulverized material.

8. A fuel supply system (1) according to claim 1, wherein the temperature-responsive member (9) is formed by an elongated body (9), a change of length of said elongated body in response to temperature affects the position of the movable body (8), and wherein the member (9) is connected to the engine in order to sense the temperature the engine.

9. A fuel supply system (1) according to claim 1, therein said air-regulating valves comprise a choke valve (5) and a throttle valve (6), said choke valve being non-rotationally secured to a choke control lever (35) and said throttle valve being rotationally secured to a throttle lever (36), said choke control lever (35) carrying a non-rotationally mounted choke valve arm (37) and a rotationally mounted blocking arm (38), the blocking arm being provided with a drive shoulder (41) arranged to drive the choke valve arm (37) in a direction towards opening of the choke valve (5), and a biased check spring (39) arranged so as to turn the blocking arm (38) and, thus, the choke valve arm (37) to open the choke valve, and a rotary movement of the choke valve arm (37) from the open position also causing a rotational movement of the blocking arm (38), the outer end (47) of said blocking arm cooperates with the throttle valve arm (43) to turn the throttle valve arm from its normally closed position, and the blocking arm (38) and throttle valve arm being provided with cooperating hook members (48, 49) arranged to interlock in a position of full choke of the choke valve (5) and an adjusted start throttle condition of the throttle valve (6), said hooking members being an indentation (48) formed at the outer end (47) of the blocking arm (38) to cooperate with an abutment means (49) at one end of the throttle valve arm.

10. A fuel supply system (1) according to claim 1, wherein the fuel supply system is a carburetor having a membrane and a metering chamber.

11. A fuel supply system (1) according to claim 10, wherein a pumping means (50–58) having a suction line (50) connected to the metering chamber (11) of the carburetor is arranged adjacent the carburetor and is operable to pump an air/fuel mixture from the metering chamber.

12. A fuel supply system (1) according to claim 1, wherein said movable body (8) is selected from the group consisting of a plunger and a secured membrane.

13. A fuel supply system (1) according to claim 1, wherein said temperature responsive member (9) is selected from the group consisting of a bimetal element, a shape memory member, and an external rod.

* * * * *

UNITED STATES PATENT AND TRADEMARK OFFICE

CERTIFICATE OF CORRECTION

PATENT NO. : 5,992,829
DATED : November 30, 1999
INVENTOR(S) : Bo Andreasson

It is certified that error appears in the above-indentified patent and that said Letters Patent is hereby corrected as shown below:

On the title page, item [57], line 3 "comprising" should be --including--.

Column 8, line 49, claim 9 "therein" should be --wherein--.

Signed and Sealed this

Twenty-fifth Day of July, 2000

*Attest:*

Q. TODD DICKINSON

*Attesting Officer*

*Director of Patents and Trademarks*